US008445765B2

(12) United States Patent
Sawada et al.

(10) Patent No.: US 8,445,765 B2
(45) Date of Patent: May 21, 2013

(54) KEYBOARD DEVICE

(75) Inventors: Mutsuo Sawada, Shizuoka (JP); Shiro Uno, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 13/343,716

(22) Filed: Jan. 5, 2012

(65) Prior Publication Data

US 2012/0174729 A1 Jul. 12, 2012

(30) Foreign Application Priority Data

Jan. 12, 2011 (JP) ..... 2011-003602

(51) Int. Cl.
*G10C 3/12* (2006.01)

(52) U.S. Cl.
USPC ..... 84/439; 84/433; 84/423 R

(58) Field of Classification Search
USPC ..... 84/433, 439, 423 R
See application file for complete search history.

(56) References Cited

U.S. PATENT DOCUMENTS 4,856,407 A * 8/1989 Katsuta et al. ..... 84/439
5,204,486 A * 4/1993 Kim et al. ..... 84/439
5,574,241 A * 11/1996 Kumano et al. ..... 84/439
6,121,535 A * 9/2000 Muramatsu ..... 84/626
6,930,234 B2 * 8/2005 Davis ..... 84/423 R
2008/0307944 A1 * 12/2008 Watanabe ..... 84/433
2012/0174729 A1 * 7/2012 Sawada et al. ..... 84/236

FOREIGN PATENT DOCUMENTS

JP H04-165396 6/1992
JP H04-166995 6/1992

* cited by examiner

*Primary Examiner* — David Warren
*Assistant Examiner* — Robert W Horn
(74) *Attorney, Agent, or Firm* — Jianq Chyun IP Office

(57) ABSTRACT

A keyboard device capable of reconstructing a unique clicking sense of an acoustic piano is provided. A first incline portion (a plane or curved surface) of a sliding surface is inclined towards a direction gradually departing from a base portion of a protrusion along a displacement direction of the protrusion in a key-pressing operation for reducing a resistance exerted on the protrusion and suppressing a gradual increase of a sense of resistance. Moreover, a bump portion located at where the protrusion reaches after sliding through the first incline portion is used to increase the resistance exerted on the protrusion for increasing the sense of resistance. When the protrusion crosses over the bump portion, the sense of resistance is reduced. Accordingly, variation in the sense of resistance before and after the bump portion is increased, and the unique clicking sense of the acoustic piano is reproduced.

8 Claims, 7 Drawing Sheets

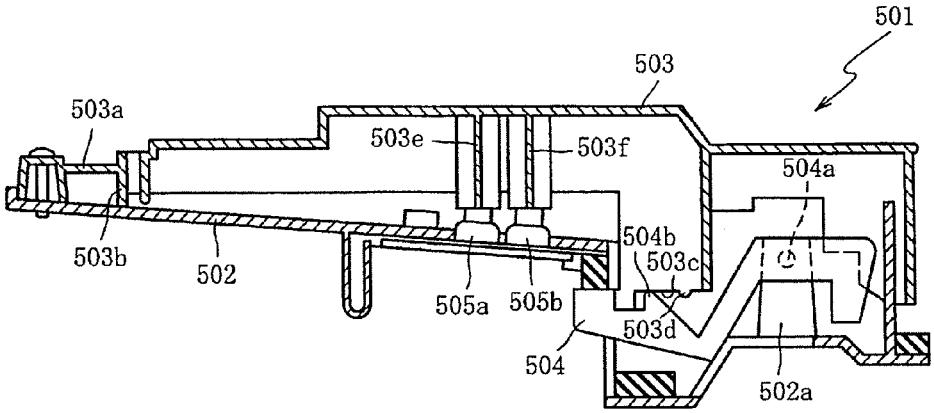
FIG. 7 (a) (Related Art)
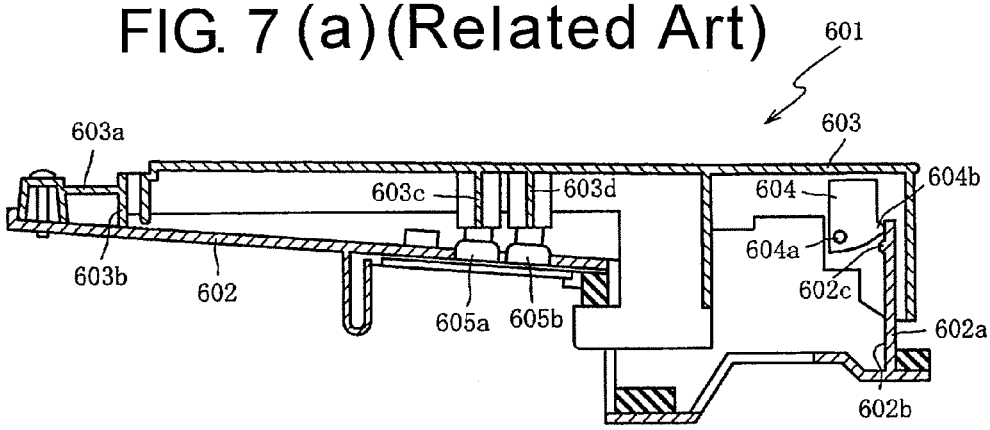
FIG. 7 (b) (Related Art)
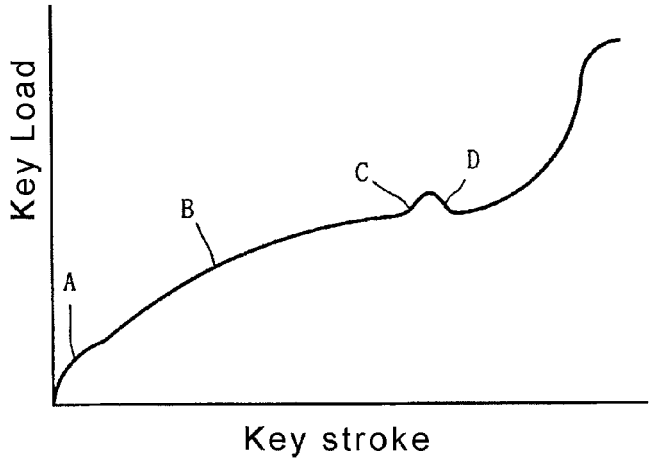
FIG. 7 (c) (Related Art)

KEYBOARD DEVICE

CROSS-REFERENCE TO RELATED APPLICATION

This application claims the priority benefit of Japan application serial no. 2011-003602, filed on Jan. 12, 2011. The entirety of the above-mentioned patent application is hereby incorporated by reference herein and made a part of this specification.

BACKGROUND OF THE INVENTION

1. Field of the Invention

The invention relates to a keyboard device. Particularly, the invention relates to a keyboard device capable of reconstructing a unique clicking sense of an acoustic piano.

2. Description of Related Art

Traditionally, in an electronic keyboard instrument such as an electronic piano, hammers with a specific mass are disposed under the keys, and the hammer may undergo a rotational displacement according to a key-pressing operation. In this way, a specific action load is applied to a key to achieve a sense of key-touching of an acoustic piano. An acoustic piano has a following unique clicking sense, for example, when the key is slowly clicked, a sense of resistance increases in the middle of the process and rapidly decreases thereafter. By reconstructing such clicking sense, the key touching sense of an electronic keyboard instrument can be closer to the key touching sense of an acoustic piano.

Regarding the aforementioned technique, a following technique is disclosed in a Patent document 1 or a Patent document 2. A protrusion is disposed at a specific portion of the hammer, and the protrusion is slidably connected to a chassis (a guide portion) or a key. The technique disclosed in the Patent document 1 or the Patent document 2 is described in detail below with reference to FIG. 7(*a*), FIG. 7(*b*) and FIG. 7(*c*).

FIG. 7(*a*) is a side view of a keyboard device 501 disclosed in the Patent document 1, which illustrates a key-releasing state, for example an initial state. As shown in FIG. 7(*a*), the keyboard device 501 includes the following parts: a chassis 502, which is fixed on a shelf of the electronic keyboard instrument (not shown); a key 503, where one end of the key 503 is rotatably fixed to the chassis 502 through a hinge 503*a* while a pivot 503*b* serves as a rotation centre, and another end is formed with a flat surface 503*c* facing downwards; a bump portion 503*d* with a roughly semicircular cross-section, which is disposed on and protruded from a front portion of the flat surface 503*c* of the key 503; a hammer assembling portion 502*a*, which is erected on the chassis 502 under the key 503; a hammer 504, which is rotatably supported by the hammer assembling portion 502*a* at a rotation shaft 504*a* as the rotation centre, and is provided with energy to move along a clockwise direction of FIG. 7(*a*) due to the deadweight of the hammer 504; and a protrusion 504*b*, which is configured at the back portion of the hammer 504 and leans against the flat surface 503*c* located behind the bump portion 503*d*.

Moreover, in the keyboard device 501, a first key switch 505*a* and a second key switch 505*b* used for detecting key pressing information are disposed on the chassis 502. On the other hand, the key 503 has a first switch pressing portion 503*e* and a second switch pressing portion 503*f* disposed protruding downwards corresponding to the first key switch 505*a* and the second key switch 505*b*. When the key 503 is slowly pressed, the key 503 and the flat surface 503*c* are displaced in a descending direction, and the first key switch 505*a* and the second key switch 505*b* are sequentially pressed by the first switch pressing portion 503*e* and the second switch pressing portion 503*f* corresponding to the descending displacement. And, the protrusion 504*b* of the hammer 504 is in sliding contact with the flat surface 503*c*, and crosses over the bump portion 503*d*, and displaces to a front portion (a right side of FIG. 7(*a*)) of the flat surface 503*c*.

FIG. 7(*b*) is a side view of a keyboard device 601 disclosed in the Patent document 2, which illustrates a key-releasing state, for example an initial state. As shown in FIG. 7(*b*), the keyboard device 601 includes following parts: a chassis 602, which is fixed on a shelf of the electronic keyboard instrument (not shown); a guide portion 602*a* (a part of the chassis 602), which is erected at a front portion (the right side of FIG. 7(*b*)) of the chassis 602; a bump portion 602*c* with a roughly semicircular cross-section, which is disposed on a flat surface 602*b* of a back portion of the guide portion 602*a* in protrusion; a key 603, where one end of the key 603 is rotatably fixed to the chassis 602 through a hinge 603*a* while a pivot 603*b* is served as a rotation centre, and another end of the key 603 supports a rotation shaft 604*a*; a hammer 604, which is rotatably supported by the rotation shaft 604*a* as the rotation centre, and the rotation shaft 604*a* is supported by the key 603, and is provided with energy to move along a clockwise direction of FIG. 7(*b*) due to the deadweight of the hammer 604; and a protrusion 604*b*, which is configured and protruded at the front portion of the hammer 604, and leans against the flat surface 602*b* at a top portion of the bump portion 602*c* on the guide portion 602*a*.

Moreover, in the keyboard device 601, a first key switch 605*a* and a second key switch 605*b* used for detecting key pressing information are disposed on the chassis 602. On the other hand, the key 603 has a first switch pressing portion 603*c* and a second switch pressing portion 603*d* disposed protruding downwards corresponding to the first key switch 605*a* and the second key switch 605*b*. When the key 603 is slowly pressed, the key 603 and the hammer 604 are displaced in a descending direction, and the first key switch 605*a* and the second key switch 605*b* are sequentially pressed by the first switch pressing portion 603*c* and the second switch pressing portion 603*d* corresponding to the descending displacement. And, the protrusion 604*b* of the hammer 604 is in sliding contact with the flat surface 602*b* of the guide portion 602*a*, and crosses over the bump portion 602*c*, and displaces to a lower portion (a down side of FIG. 7(*b*)) of the guide portion 602*a* (the flat surface 602*b*).

Next, a key load of the keyboard device 501 shown in FIG. 7(*a*) is described below. FIG. 7(*c*) is a schematic diagram illustrating a relationship of key stroke and key load. Moreover, in the following descriptions of the keyboard devices 501 and 601, relationships of the flat surfaces 503*c*, 602*b*, the bump portions 503*d*, 602*c* and the protrusions 504*b* and 604*b* are stressed, so that descriptions of the loads produced when the first switch pressing portions 503*e*, 603*c* and the second switch pressing portions 503*f*, 603*d* press the first key switches 505*a*, 605*a* and the second key switches 505*b*, 605*b* are omitted.

When the key 503 is pressed, the key 503 rotates downwards along the pivot 503*b* as the rotation centre. First, a load resulted from an elastic force of the hinge 503*a* and a provided energy force (the clockwise direction of FIG. 7(*a*)) of the hammer 504 is applied on the key 503 (a symbol A of FIG. 7(*c*)). Then, when the protrusion 504*b* of the hammer 504 is in sliding contact with the flat surface 503*c* of the key 503, a resistance due to the friction between the flat surface 503*c* and the protrusion 504*b* is generated. A load caused by the resistance is gradually increased as the key 503 rotates (a symbol B of FIG. 7(*c*)). Then, a load caused by a resistance generated when the protrusion 504*b* of the hammer 504 pushes against the bump portion 503*d* is applied on the key 503 (a symbol C of FIG. 7(*c*)), and when the protrusion 504*b* crosses over the bump portion 503*d*, the load applied on the key 503 is decreased (a symbol D of FIG. 7(*c*)).

A key load of the keyboard device 601 shown in FIG. 7(*b*) is the same, and when the key 603 is pressed, the key 603 rotates downwards along the pivot 603*b* as the rotation centre. First, a load resulted from an elastic force of the hinge 603*a* and a mass of the hammer 504 is applied on the key 603 (the symbol A of FIG. 7(*c*)). Then, when the protrusion 604*b* of the hammer 604 is in sliding contact with the flat surface 602*b* of the guide portion 602*a*, a resistance due to the friction between the flat surface 602*b* and the protrusion 604*b* is generated. A load resulted from the resistance is gradually increased as the key 603 rotates (the symbol B of FIG. 7(*c*)). Then, a load resulted from a resistance generated when the protrusion 604*b* of the hammer 604 pushed against the bump portion 602*c* functions on the key 603 (the symbol C of FIG. 7(*c*)), and when the protrusion 604*b* crosses over the bump portion 602*c*, the load applied on the key 603 becomes smaller (the symbol D of FIG. 7(*c*)).

As described above, in the keyboard devices 501 and 601 disclosed by the Patent document 1 and the Patent document 2, a sense of resistance is increased when the protrusions 504*b* and 604*b* push against the bump portions 503*d* and 602*c*, and when the protrusions 504*b* and 604*b* cross over the bump portions 503*d* and 602*c*, the sense of resistance is mitigated.

DOCUMENT OF PRIOR ART

Patent Document

[Patent document 1] Japan Patent Publication No. H04-165396

[Patent document 2] Japan Patent Publication No. H04-166995

However, in the above background techniques, even before the protrusion pushes against the bump portion, as the key rotates, the resistance is produced when the protrusion is in sliding contact with the flat surface, and the load resulted from such resistance is applied on the key in a gradual increasing manner. As a result, after the sense of resistance is gradually increased corresponding to the key stroke, due to the protrusion pushes against the bump portion, a following problem is encountered, for example, an increase of the sense of resistance when the protrusion pushes against the bump portion is hard to be recognized. Moreover, after the protrusion crosses over the bump portion, due to the protrusion is in sliding contact with the flat surface, a following problem is encountered, for example, a decrease in the sense of resistance when the protrusion crosses over the bump portion is hard to be recognized. Such variations in the sense of resistance that are hard to be recognized are different from the clicking sense of the acoustic piano, and a problem of incompatibility is resulted.

SUMMARY OF THE INVENTION

The invention is directed to a keyboard device capable presenting a unique clicking sense of an acoustic piano without any sense of incompatibility.

The first technical resolution provides a keyboard device, in which a hammer is displaced rotationally in correspondence to a key-pressing operation or a key-releasing operation of a key to apply an action load to the key. And, a protrusion projected at a specific position on the hammer or the key slides on a sliding surface corresponding to the key-pressing operation or the key-releasing operation. The sliding surface is formed on any one of a chassis, the key and the hammer. The sliding surface has a flat surface or a curved surface inclined to a direction which is along a sliding direction of the protrusion in the key-pressing operation and gradually departs from a base portion of the protrusion. A bump portion is formed in continuation with the flat surface or the curved surface, and raises up from the sliding surface towards a direction which is close to the base portion of the protrusion along a sliding direction of the protrusion in the key-pressing operation.

Therefore, after the protrusion slides through the flat surface or the curved surface to arrive to the bump portion, the resistance exerted on the protrusion sliding on the flat surface or the curved surface is reduced, so as to suppress a gradual increase of the sense of resistance. Moreover, when the protrusion pushes against the bump portion, the sense of resistance is increased, and when the protrusion crosses over the bump portion, the sense of resistance is decreased. In this situation, a variation in the sense of resistance produced when the protrusion pushes against the bump portion is increased, so that even if the variation in the sense of resistance produced when the protrusion crosses over the bump portion is relatively small, it can be still recognized that the sense of resistance has a large variation before and after the bump portion.

Moreover, when the protrusion crosses over the bump portion to arrive to the flat surface or the curved surface, a variation of the sense of resistance produced when the protrusion crosses over the bump portion is increased, so that even if the variation of the sense of resistance produced when the protrusion pushes against the bump portion is relatively small, it can be still recognized that the sense of resistance has a large variation before and after the bump portion.

As described above, a change in the position of the protrusion sliding on the sliding surface can be recognized as a larger variation of the sense of resistance, so that a following effective is achieved, for example, the unique clicking sense of the acoustic piano is presented without a sense of incompatibility.

According to the keyboard device of a second technical resolution, the sliding surface has a first incline portion, and the first incline portion is located at a section from where the protrusion starts to slide to the bump portion in the key-pressing operation. The first incline portion is inclined to a direction which is along a sliding direction of the protrusion in the key-pressing operation and gradually departs from the base portion of the protrusion. Therefore, the resistance exerted on the protrusion sliding on the first incline portion can be reduced, so as to suppress a gradual increase of the sense of resistance. In this way, the variation in the sense of resistance produced when the protrusion pushes against the bump portion is increased. Accordingly, asides from the effect of the first technical solution, an effect of strengthening the clicking sense is achieved.

According to the keyboard device of a third technical resolution, the sliding surface has a second incline portion, and the second incline portion is located at a place where the protrusion reaches after crossing over the bump portion in the key-pressing operation, and is inclined to a direction which is along a sliding direction of the protrusion in the key-pressing operation and gradually departs from the base portion of the protrusion. Since the second incline portion has an inclined angle greater than that of the first incline portion, the resistance exerted on the protrusion crosses over the bump portion can be greatly reduced. In this way, asides from the effect of the second technical solution, an effect of further strengthening the clicking sense is achieved.

According to the keyboard device of a fourth technical resolution, the bump portion is set to have an inclined angle greater than that of the first incline portion, so that the sense of resistance can be greatly increased through the bump portion. In this way, asides from the effect of the second or third technical solution, a further similar effect of a clicking sense of an acoustic piano can be achieved.

According to the keyboard device of a fifth technical resolution, the sliding surface formed at the specific portion of the hammer is located at a position where an included acute angle between a straight line connecting a start end of the sliding surface and a rotation shaft of the hammer in the key-releasing operation, and a plane passing through a rotation shaft of the key and the rotation shaft of the hammer is 30°-60°. In this way, an interference distance between the protrusion formed at the specific portion of the key and the sliding surface can be extended, so that a sliding distance of the protrusion can be extended. As a result, a variation in the fabrication of the position or the height of the bump portion relative to the sliding surface is reduced, so as to ensure with certainty a rotation of the hammer when the protrusion presses the sliding surface and to ensure with certainty a touch weight is applied to the key. In this way, asides from any of the effects of the first technical solution to the fourth technical solution, an effect of suppressing a variation of a key touching sense is achieved.

According to the keyboard device of a sixth technical resolution, the protrusion or the sliding surface is formed or covered by a flexible member. Therefore, asides from any of the effects of the first technical solution to the fifth technical solution, an effect of reducing a scratching noise generated due to friction between the protrusion and the sliding surface is achieved.

According to the keyboard device of a seventh technical resolution, a connection protrusion of a hammer body is inserted in an insertion hole of a connection member, and the connection member is connected to the hammer body to fabricate the hammer. Therefore, asides from any of the effects of the first technical solution to the sixth technical solution, an effect of producing a hammer in a simple manner is achieved. Accordingly, the connection member with the flexible member is integrally formed to form the sliding surface, so as to achieve an effect of reducing a scratching noise generated due to friction between the protrusion and the sliding surface.

According to the keyboard device of a eighth technical resolution, the sliding surface is located under the protrusion, and any one of the chassis, the key and the hammer has a wall portion. The wall portion is erected around the sliding surface and surrounds the sliding surface. Therefore, when a lubricant such as grease is coated on the sliding surface surrounded by the wall portion, the lubricant is stayed inside the wall portion. As a result, the lubricant is prevented from flowing out from the sliding surface. In this way, asides from any of the effects of the first technical solution to the seventh technical solution, a long-term effect of preventing wearing of the protrusion or the sliding surface and generation of scratching noise is achieved.

In order to make the aforementioned and other features and advantages of the invention comprehensible, several exemplary embodiments accompanied with figures are described in detail below.

BRIEF DESCRIPTION OF THE DRAWINGS

The following drawings are included to provide a further understanding of the invention, and are incorporated in and constitute a part of this specification. The drawings illustrate embodiments of the invention and, together with the description, serve to explain the principles of the invention.

FIG. 3(*b*) is a schematic diagram illustrating a relationship of key stroke and key load.

FIG. 4(*b*) is a three-dimensional view of a hammer of a keyboard device according to a third embodiment of the invention.

FIG. 5(*b*) is a partial cross-sectional view of a hammer of a keyboard device according to a fifth embodiment of the invention.

FIG. 5(*c*) is an enlarged side view of a part of a keyboard device according to a sixth embodiment of the invention.

FIG. 6(*b*) is a cross-sectional view of a sliding surface of a keyboard device according to an eighth embodiment of the invention.

FIG. 6(*c*) is a cross-sectional view of a sliding surface of a keyboard device according to a ninth embodiment of the invention.

FIG. 7(*a*) is a side view of a conventional keyboard device.

FIG. 7(*b*) is a side view of a conventional keyboard device.

FIG. 7(*c*) is a schematic diagram illustrating a relationship of key stroke and key load.

DETAILED DESCRIPTION OF DISCLOSED EMBODIMENTS

Figure 1:
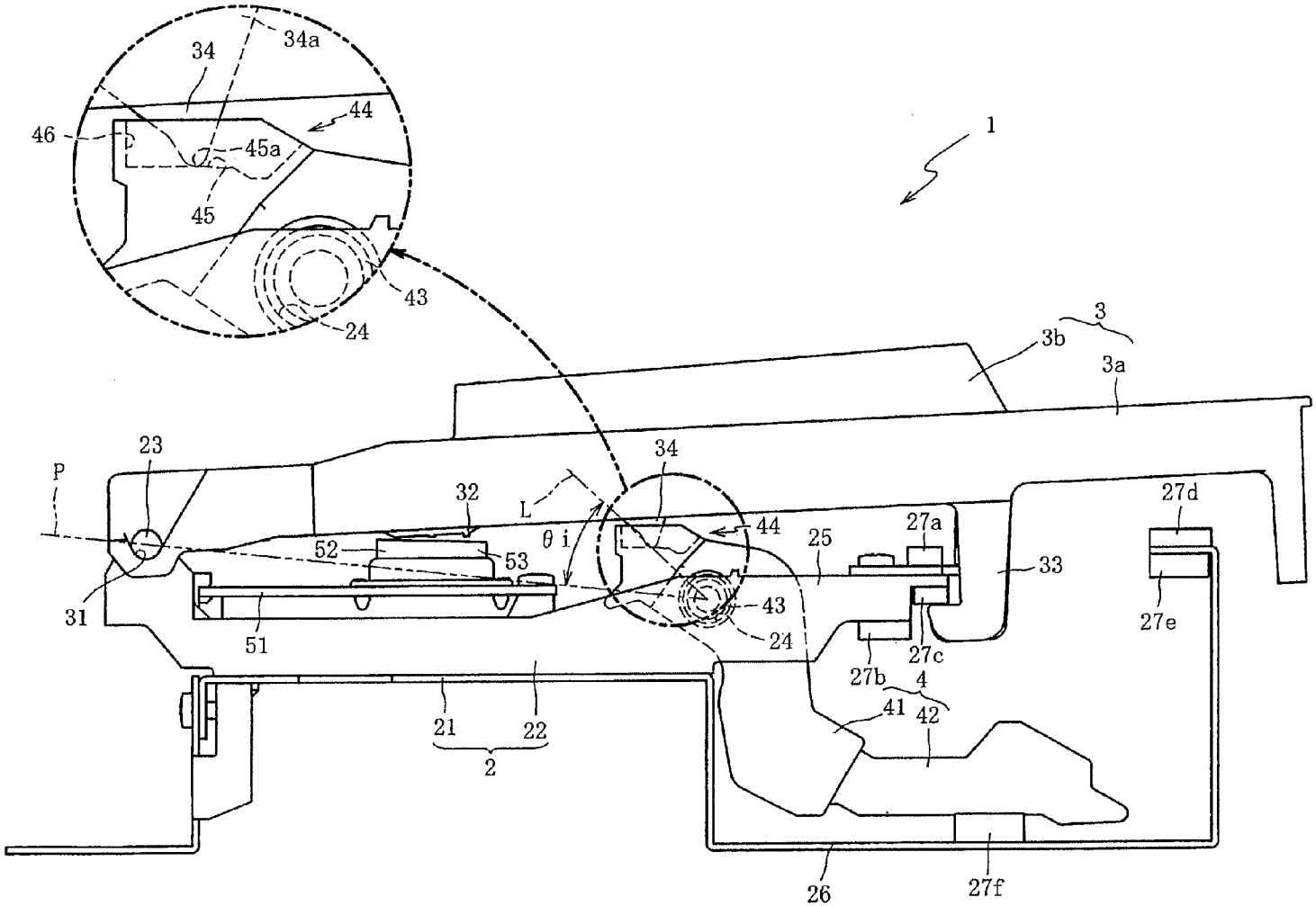
FIG. 1 is a side view of a keyboard device of a first embodiment of the invention.
Figure 2:
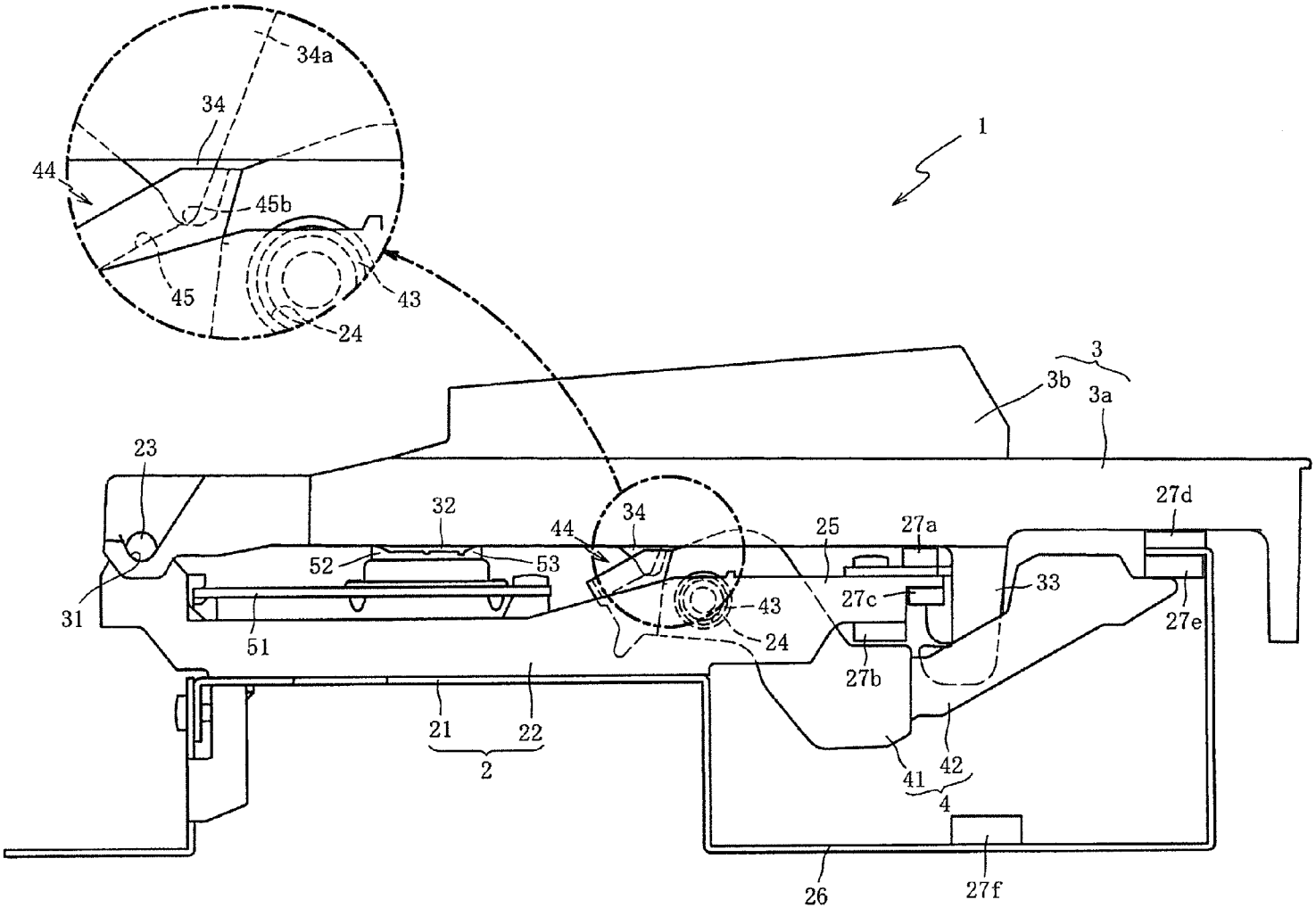
FIG. 2 is a side view of a keyboard device.

Exemplary embodiments of the invention are provided below with reference to the figures. First, a keyboard device 1 of a first embodiment of the invention is described with reference to FIG. 1 to FIG. 3(*a*) and FIG. 3(*b*). FIG. 1 and FIG. 2 are side views of the keyboard device 1 of the first embodiment of the invention, in which FIG. 1 illustrates a key-releasing state, for example an initial state, and FIG. 2 illustrates a key-pressing state. A left-right direction of the keyboard device 1 is defined according to an observation direction of a player when the keyboard device 1 is applied to an electronic keyboard apparatus (not shown), and regarding the front-back direction of the keyboard device 1, a player side of the keyboard device 1 is regarded as the "front" when the keyboard device 1 is applied to the electronic keyboard apparatus (not shown).

The keyboard device 1 shown in FIG. 1 serves as a keyboard operation part of a player, and is used for detecting an operating state of a key 3, and is suitable for applying to an electronic keyboard instrument (not shown) such as an electronic piano, etc. The keyboard device 1 mainly includes the following parts: a chassis 2, which is formed by using a synthetic resin material or a steel plate, etc.; a plurality of keys 3 (for example, 88), which are rotatably supported by the chassis 2 and are constructed with white keys 3 and black keys 3*b*; and a hammer 4, which is configured to each of the keys 3 and rotates along with the key-pressing operation or the key-releasing operation of the key 3.

The keys 3 (the white keys 3*a* and the black keys 3*b*) are disposed on an upper surface (a top side of FIG. 1) of the chassis 2, and the hammers 4 are respectively disposed corresponding to the keys 3 and located inside the chassis 2, and the hammers 4 are arranged along a left-right direction (a direction vertical to a page surface of FIG. 1) of the chassis 2. Moreover, regarding the mechanism for rotating the hammer 4 along with the key-pressing operation or the key-releasing operation, the same mechanism is applied for both of the white key 3*a* and the black key 3*b*; therefore, in following disclosure, the white key 3*a* is used as an example for description, and the disclosure of the black key 3*b* is omitted.

The chassis 2 is a member which forms a framework of the keyboard device 1, and the chassis 2 includes a chassis body 21 and a chassis enhancement member 22 fixed on an upper surface of the chassis body 21. The chassis enhancement member 22 has a key supporting protrusion 23 at a rear end thereof. The key supporting protrusion 23 is used for rotatably supporting each of the keys 3, and the key supporting protrusion 23 is formed for each of the keys 3. A supporting hole 31 pivoted to a side wall portion of the key 3 is engaged with the key supporting protrusion 23 (a rotation shaft), and the key 3 is rotatably supported (pivotal support) by the chassis 2.

A hammer supporting recesses 24 are locations for rotatably supporting the hammers 4. The hammer supporting recesses 24 are approximately formed at a central portion of the chassis 2, and are formed in recession at two sidewalls of an opening portion (not shown) formed by a front end of the chassis enhancement member 22 for each of the hammers 4. Hammer supporting protrusions 43 formed at two sidewalls of the hammer 4 are engaged with the hammer supporting recesses 24, and the hammer 4 is rotatably supported (pivotal support) by the chassis 2. Moreover, the opening portion has a size suitable for float plugging the hammer 4, so that the hammer 4 can be rotated at the front end of the chassis enhancement member 22.

On an upper surface of the chassis enhancement member 22 between the key supporting protrusion 23 and the hammer supporting recesses 24, a key switch 5 used for detecting key pressing information of the key 3 is installed. The key switch 5 has a circuit board 51 screw-locked to the chassis enhancement member 22, and a first switch 52 and a second switch 53 are disposed on an upper surface of the circuit board 51. When the first switch 52 and the second switch 53 are sequentially pressed by a switch pressing portion 32 of the key 3, the key pressing information (velocity) of the key 3 is detected according to a time difference of the ON-operations of the switches 52 and 53.

An upper extending portion 25 is an approximately horizontal extending portion which is extended from the chassis enhancement member 22 towards a front side (the right side of FIG. 1). In the case of the key-releasing operation of the key 3, the upper extending portion 25 leans against a stopper portion 33 of the key 3 to confine an upper limit position of the key 3, and in the case of the key-pressing operation of the key 3, the upper extending portion 25 leans against a lower surface of the key 3 and an upper surface of the hammer 4 to respectively confine a lower limit position of the key 3 and an upper limit position of the hammer 4 (referring to FIG. 2).

A lower extending portion 26 is disposed under and in front of the upper extending portion 2. The lower extending portion 26 extends from the chassis body 21 to the front side and approximately presents a U-shape viewed from a side view. In the case of the key-releasing operation of the key 3, the lower extending portion 26 leans against a lower surface of the hammer 4 to confine a lower limit position of the hammer 4, and in the case of the key-pressing operation of the key 3, the lower extending portion 26 leans against the upper surface of the hammer 4 to confine the upper limit position of the hammer 4 (referring to FIG. 2).

A cushion material 27*a* is disposed on an upper surface of the upper extending portion 25, and cushion materials 27*b* and 27*c* are disposed on a lower surface of the upper extending portion 25. Moreover, a cushion material 27*d* is disposed on an upper surface of a top end of the lower extending portion 26, a cushion material 27*e* is disposed on a lower surface of the top end of the lower extending portion 26, and a cushion material 27*f* is disposed on an upper surface of the bottom end of the lower extending portion 26. The cushion materials 27*a*-27*f* are used for cushioning or muffling, which are, for example, made of felt or urethane foam, etc. to absorb the impact generated during a process of confining rotation of the key 3 or the hammer 4.

The key 3 is a bar-shape member made of a synthetic resin and having a U-shape cross section opened towards the bottom side (the lower side of FIG. 1), and is disposed on the upper surface of the chassis 2. The supporting hole 31 thereon is engaged with the key supporting protrusion 23 (the rotation shaft), so that the key 3 is rotatably supported by the chassis 2. The key 3 has the stopper portion 33, which extends downwards from the sidewall of the key 3 and presents an L-shape observed from a side view. The stopper portion 33 leans against the upper extending portion 25 (the cushion material 27*c*) of the chassis 2, so that the upper limit position of the key 3 in the key-releasing operation is confined (referring to FIG. 1).

Moreover, the key 3 is formed with a protrusion 34 extending downwards from the bottom surface and roughly presenting a tapered-shape, and the protrusion 34 leans against a back end of the hammer 4. In the case of the key-releasing operation, the key 3 is lifted to an initial position (referring to FIG. 1) through a mass of the hammer 4, and in the key-pressing operation, specific touch weight is provided to the key 3 through the mass of the hammer 4.

The hammer 4 is rotated along with the key-pressing operation or the key-releasing operation of the key 3, so as to provide a touch weight which is the same as that of an acoustic piano. The hammer 4 mainly includes a hammer body 41 made of a synthetic resin, such as POM (Polyoxymethylene), etc., and a mass body 42, which is connected to the hammer body 41 to function as a weight.

The hammer supporting protrusions 43 serve as a rotation shaft rotatably supporting the hammer 4, and are configured at two sidewalls of a back end of the hammer body 41. The hammer supporting protrusions 43 are engaged with the hammer supporting recesses 24, and the hammer 4 is rotatably supported by the chassis 2. Since the mass body 42 is located prior to (the right side of FIG. 1) the hammer supporting protrusions 43, the hammer 4 is provided with energy along a clockwise direction of FIG. 1 due to a deadweight function of the mass body 42.

Here, the protrusion 34 protruding downwards from the bottom surface of the key 3 is inserted into a receiving portion 44, and the receiving portion 44 is formed at an upper surface of the back end of the hammer body 41. The receiving portion 44 includes the following parts: a sliding surface 45, which is formed along a back and front direction (the left-right direction of FIG. 1) of the hammer 4, and the protrusion 34 leans against the sliding surface 45; a wall portion 46, which is erected around the sliding surface 45. The receiving portion 44 is filled with a lubricant such as grease, etc. to prevent wearing of the protrusion 34 and the sliding surface 45 caused by the sliding contact thereof and to prevent generation of noise (scratching sound).

Moreover, by pressing the key 3, the protrusion 34 is rotated downwards (the clockwise direction of FIG. 1) with the key supporting protrusion 23 (the rotation shaft) as the centre, and the receiving portion 44 is pressed by the protrusion 34 and rotated downwards (an anticlockwise direction of FIG. 1) with the hammer supporting protrusion 43 (the rotation shaft) as the centre. In this way, the protrusion 34 is in sliding contact with the sliding surface 45 from a start end (a back end) 45*a* (referring to FIG. 1) to a terminal end (a front end) 45*b* (referring to FIG. 2). The sliding surface 45 is located under the protrusion 34 with respect to the protrusion 34. The sliding surface 45 faces upwards within a rotation range, and is surrounded by the wall portion 46, so that the lubricant is prevented from flowing out from the receiving portion 44. As a result, a long-term effect of preventing wearing of the protrusion 34 or the sliding surface 45 and generation of noise is achieved.

Figure 3:
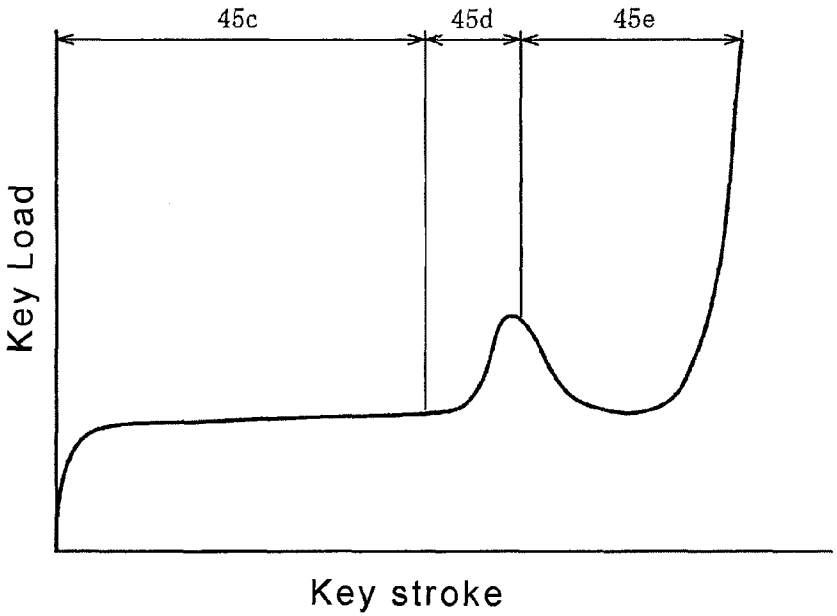
FIG. 3(*a*) is a cross-sectional view of a sliding surface.
Figure 3:
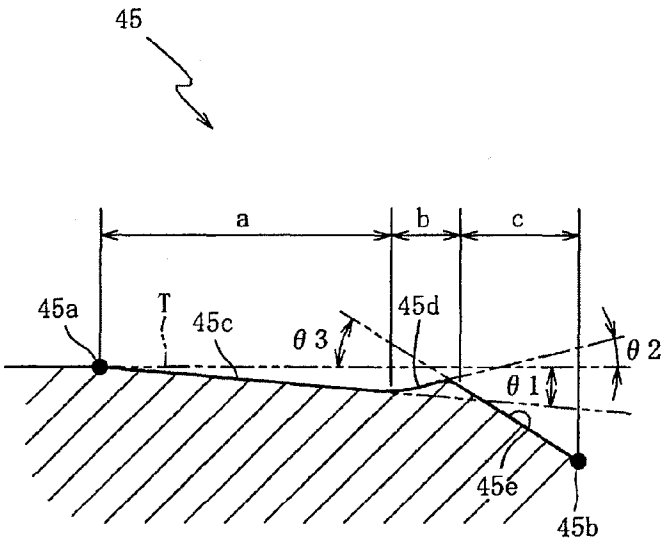

The sliding surface 45 is a surface on which the protrusion 34 slides along an orthogonal direction (the left-right direction of FIG. 1) of an axial direction of the hammer supporting protrusion 43 in the key-pressing operation or the key-releasing operation. The sliding surface 45 can be used to adjust a key load relative to a key stroke, and is formed in a bumpy shape correspond to the relative sliding direction of the protrusion 34. Below, the sliding surface 45 and the key load under the key-pressing operation are described with reference of FIG. 3(*a*) and FIG. 3(*b*). FIG. 3(*a*) is a cross-sectional view of the sliding surface 45, and FIG. 3(*b*) is a schematic diagram illustrating a relationship of key stroke and key load. Moreover, FIG. 3(*b*) illustrates the key load in the key-pressing operation, and in the key pressing operation, the protrusion 34 slides from the left to the right on the sliding surface 45 as shown in FIG. 3(*a*).

As shown in FIG. 3(*a*), the sliding surface 45 includes the following parts: a first incline portion 45*c*, which is inclined to a direction, which is along a sliding direction (from the left to the right of FIG. 3(*a*)) of the protrusion 34 in the key-pressing operation and gradually departs from a base portion 34*a* of the protrusion 34 (referring to FIG. 1). A bump portion 45*d*, which is formed in continuation with the first incline portion 45*c* and is at a place where the protrusion 34 arrives after passing through the first incline portion 45*c* in the key-pressing operation, and raises up towards a direction, which is along the sliding direction of the protrusion 34 in the key-pressing operation to gradually approach the base portion 34*a* of the protrusion 34, and is inclined to a direction that gradually departs from the base portion 34*a* of the protrusion 34 after crossing over a vertex. The sliding surface 45 further has a second incline portion 45*e*, which is formed in continuation with the bump portion 45*d* and is at a place where the protrusion 34 arrives after crossing over the bump portion 45*d* in the key-pressing operation, and is inclined towards a direction which is along the sliding direction of the protrusion 34 in the key-pressing operation and gradually departs from the base portion 34*a* of the protrusion 34.

The first incline portion 45*c* has a function of suppressing an increase of the key load. At the start end 45*a* (the back end) of the sliding surface 45, an inclined angle of the protrusion 34 contacting the sliding surface 45 relative to a tangent line T is set to θ1. Moreover, a projection length of the first incline portion 45*c* on the tangent line T is set to a, and in the present embodiment, the first incline portion 45*c* has a planar shape.

The bump portion 45*d* has a function of significantly increasing the key load, and an inclined angle thereof relative to the tangent line T is set to θ2. Moreover, a projection length of the bump portion 45*d* on the tangent line T is set to b. Moreover, the inclined angle θ2 of the bump portion 45*d* is greater than the inclined angle θ1 of the first incline portion 45*c*. And, the length b of the bump portion 45*d* is shorter than the length a of the first incline portion 45*c*.

The second incline portion 45*e* has a function of significantly decreasing the key load, and an inclined angle thereof relative to the tangent line T is set to θ3. Moreover, a projection length of the second incline portion 45*e* on the tangent line T is set to c. Further, in the present embodiment, the second incline portion 45*e* has a planar shape. Moreover, the inclined angle θ3 of the second incline portion 45*e* is greater than the inclined angle θ1 of the first incline portion 45*c*. The length c of the second incline portion 45*e* is shorter than the length a of the first incline portion 45*c*, and is longer than the length b of the bump portion 45*d*.

Referring to FIG. 3(*b*) to describe the key load in the key-pressing operation. First, when the key 3 (referring to FIG. 1) is pressed and began to rotate, due to the mass of the hammer 4 functions on the key 3 through the protrusion 34, the key load is greatly increased. As the hammer 4 rotates, the protrusion 34 is in sliding contact on the first incline portion 45*c* (a plane). Since the first incline portion 45*c* is inclined to the direction gradually departing from the base 34*a* of the protrusion 34, an increase of the key load is suppressed.

Then, the sliding contact protrusion 34 arrives to the bump portion 45*d* and pushes against the bump portion 45*d*; the key load is thereby increased. Moreover, when the protrusion 34 crosses over the vertex of the bump portion 45*d*, the key load is decreased. Herein, the key 3 is provided with a clicking sense with coming off feeling. Then, when the key 3 further rotates and the protrusion 34 slides on the second incline portion 45*e* (a plane) to arrive to the terminal end (the front end) 45*b* of the sliding surface 45 (referring to FIG. 3(*a*), the hammer 4 leans against the cushion material 27*e* (referring to FIG. 2), and the key load is increased significantly, so that rotations of the hammer 4 and the key 3 are stopped.

Moreover, since the inclined angle θ2 of the bump portion 45*d* is greater than the inclined angle θ1 of the first incline portion 45*c*, the key load can be significantly increased through the bump portion 45*d*. Accordingly, the clicking sense can be much closer to the clicking sense of the acoustic piano. Moreover, since the inclined angle θ3 of the second incline portion 45*e* is greater than the inclined angle θ1 of the first incline portion 45*c*, the key load can be greatly decreased after crossing over the bump portion 45*d*. In this way, the clicking sense is further enhanced.

Moreover, since the length b of the bump portion 45*d* is shorter than the length a of the first incline portion 45*c*, a key stroke that the protrusion 34 slides on the first incline portion 45*c* is ensured to be relatively long, and the key load is approximately same on the first incline portion 45*c*. Accordingly, since the length c of the second incline portion 45*e* is shorter than the length a of the first incline portion 45*c* and is longer than the length b of the bump portion 45*d*, a key stroke, from when the clicking sense is provided until rotations of the hammer 4 and the key 3 are stopped, is shortened. In this way, the key touching sense can be much closer to the key touching sense of the acoustic piano.

Moreover, in the keyboard device 1, the mass body 42 of the hammer 4 is accommodated in a space of the chassis 2 under the key 3, and the sliding surface 45 is located at an opposite corner relative to the mass body 42, and the protrusion 34 leans against the sliding surface 45 from the top. Therefore, the protrusion 34 can detect with a high sensitivity a variation of the key load caused by the hammer 4. The bump and the recess formed by the first incline portion 45*c*, the bump portion 45*d* and the second incline portion 45*e* on the sliding surface 45 are tiny. Though as described above, the detection sensitivity of the protrusion 34 detecting the bump and the recess of the sliding surface 45 can be improved to reconstruct a delicate key touching sense of the acoustic piano.

Return to FIG. 1, the position of the sliding surface 45 is set to a position where an included acute angle θi between a straight line L connecting the start end 45*a* (the back end) of the sliding surface 45 and an axial center of the hammer supporting protrusion 43 (the rotation shaft of the hammer 4) in the key-releasing operation. Further, a plane P passing through an axial center of the key supporting protrusion 23 (the rotation shaft of the key 3) and an axial center of the hammer supporting protrusion 43 is 30°-60°. In this way, a displacement distance of the protrusion 34 relative to the sliding surface 45 along the back and front direction (the left-right direction in FIG. 1) is prolonged. As a result, a variation in the fabrication of the position or the height of the first incline portion 45*c* and the bump portion 45*d* relative to the sliding surface 45 is reduced. Accordingly, a rotation of the hammer 4 when the protrusion 34 presses the sliding surface 45 can be ensured with certainty, and a touch weight provided to the key 3 can be ensured with certainty. In this way, the generation of variation of a key touching sense can be suppressed.

Moreover, as the acute included angle θi becomes smaller than 30°, the displacement distance of the protrusion 34 relative to the sliding surface 45 is shortened. Moreover, as the acute included angle θi becomes greater than 60°, the protrusion 34 presses the part of the sliding surface 45 proximal to the axial center of the hammer supporting protrusion 43 (the rotation shaft of the hammer 4) along the horizontal direction. Hence, the certainty that the hammer 4 is rotated through the pressing of the protrusion 34 is decreased.

As described above, in the key-pressing operation, gradual increase of the key load is suppressed through the first incline portion 45*c*. Then, the key load is increased when the protrusion 34 pushes against the bump portion 45*d*. Thereafter, the key load is decreased after the protrusion 34 crosses over the bump portion 45*d*. In this way, the key load relative to the key stroke in the key-pressing operation is similar to the unique clicking sense of the acoustic piano, so that the key touching sense of the acoustic piano is reconstructed without any incompatibility.

Figure 4:
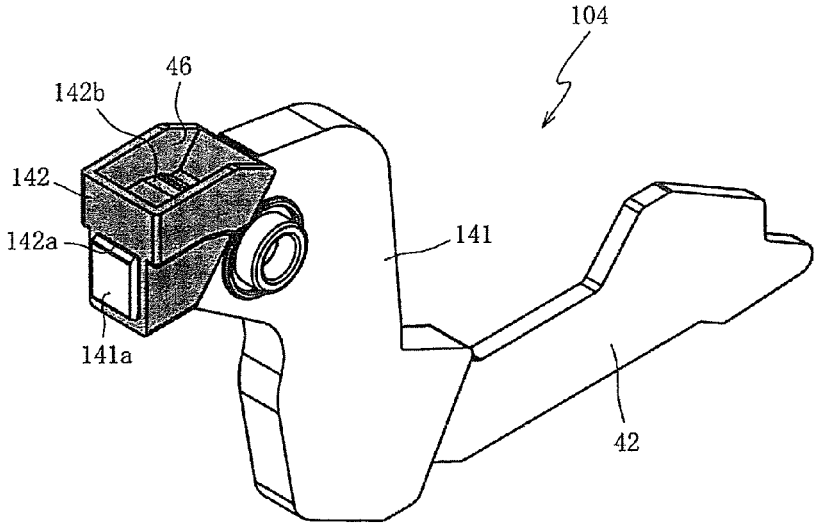
FIG. 4(*a*) is a three-dimensional view of a hammer of a keyboard device according to a second embodiment of the invention.
Figure 4:
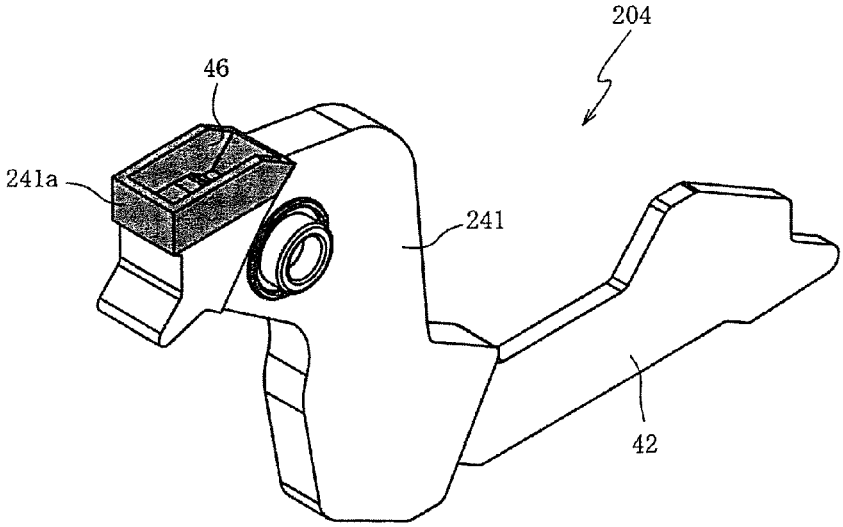

A second embodiment is provided below with reference to FIG. 4(*a*). In the first embodiment, a situation that the sliding surface 45 serves as a part of the hammer body 41 (the hammer 4) and is formed integrally with the hammer body 41 is described. Comparatively, in the second embodiment, a situation that a connection member 142 and the hammer body 141 are separately formed and a sliding surface 142*b* is formed on the connection member 142 is described. FIG. 4(*a*) is a three-dimensional view of a hammer 104 of a keyboard device according to the second embodiment of the invention. Moreover, other parts of the keyboard device, except for the hammer 104, are the same as those of the first embodiment; hence, the illustrations thereof are omitted. Further, the same reference numbers are used in the first embodiment to refer to the same or like parts, and the descriptions thereof are omitted.

The hammer 104 mainly includes a hammer body 141 constructed with a synthetic resin, such as POM (Polyoxymethylene), etc., and a mass body 42 connected to the hammer body 41. A connection protrusion 141*a* with a rectangular cross-section is integrally formed with the hammer body 141 and is disposed at the back end in protrusion. The connection member 142 is integrally formed with flexible members, where the sliding surface 142*b* is formed on a top surface, and an insertion hole 142*a* suitable for being inserted by the connection protrusion 141*a* is formed under the sliding surface 142*b*. The sliding surface 142*b* is surrounded by the wall portion 46 erected around the sliding surface 142*b*.

The aforementioned flexible member can be fabricated with a rubber material, such as silicone rubber, etc., or with thermoplastic elastomer, etc. Since the sliding surface 142*b* is formed by the flexible member, the generation of the scratching noise resulted from friction between the protrusion 34 and the sliding surface 142*b* is greatly suppressed. Therefore, by inserting the connection protrusion 141*a* of the hammer body 141 into the insertion hole 142*a* of the connection member 142, the connection member 142 is connected to the hammer body 141 to easily fabricate the hammer 104.

Moreover, when the lubricant such as grease, etc. is coated on the sliding surface 142*b* surrounded by the wall portion 46, the lubricant is prevented from flowing out from the sliding surface 142*b* due to the wall portion 46. As a result, a long-term effect of preventing wearing of the protrusion 34 or the sliding surface 142*b* and generation of the scratching noise is achieved.

Moreover, a third embodiment is provided below with reference to FIG. 4(*b*). In the second embodiment, a situation that the connection member 142 formed by the flexible members is formed separately with the hammer body 141 and the sliding surface 142*b* is formed on the connection member 142 is described. Comparatively, in the third embodiment, a situation that a flexible member is integrally formed with the hammer body 241 to form the receiving portion 241*a* (the sliding surface) is described. FIG. 4(*b*) is a three-dimensional view of a hammer 204 of a keyboard device according to the third embodiment of the invention. Moreover, other parts of the keyboard device, except for the hammer 204, are the same as those of the first embodiment; hence, the illustrations thereof are omitted. Further, the same reference numbers are used in this embodiment and the first embodiment to refer to the same or like parts, and the descriptions thereof are omitted.

The hammer 204 mainly includes a hammer body 241 fabricated with synthetic resin and a mass body 42 connected to the hammer body 241. The receiving portion 241*a* includes a flexible member, which is integrally formed with the hammer body 241 through a two-color molding process. Since the receiving portion 241*a* is formed integrally with the hammer body 241, increasing the number of used parts can be suppressed. Moreover, since the receiving portion 241*a* (the sliding surface) includes the flexible member, the generation of the scratching noise resulted from friction between the protrusion 34 and the sliding surface is suppressed. And, when the receiving portion 241*a* (the sliding surface) surrounded by the wall portion 46 is filled with a lubricant such as grease, etc., the lubricant can be prevented from flowing out from the receiving portion 241*a*. As a result, a long-term effect of preventing wearing of the protrusion 34 or the receiving portion 241*a* and generation of the scratching noise is achieved.

Figure 5:
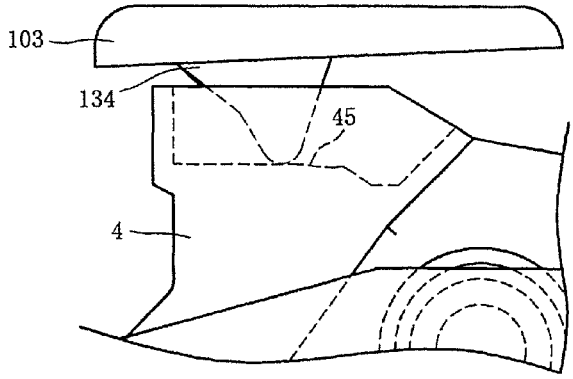
FIG. 5(*a*) is an enlarged side view of a part of a keyboard device according to a fourth embodiment of the invention.
Figure 5:
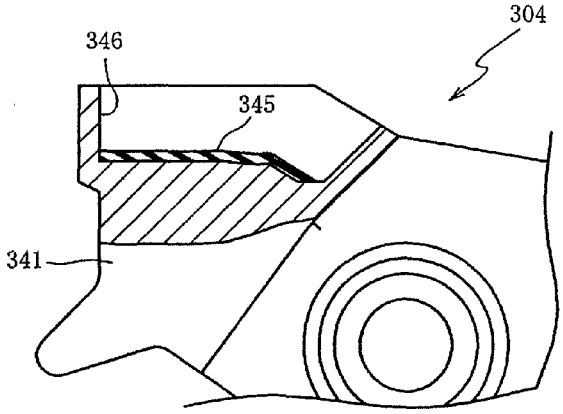
Figure 5:
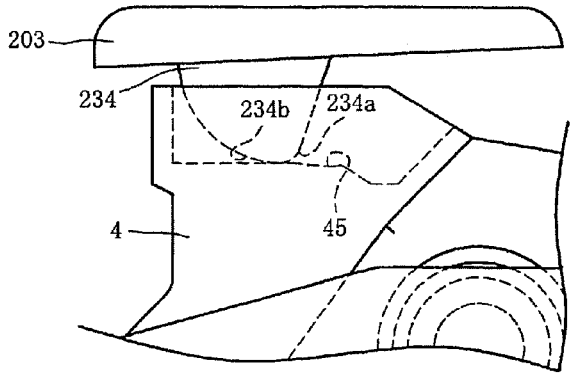

A fourth embodiment is provided below with reference to FIG. 5(*a*). In the second embodiment and the third embodiment, a situation that the sliding surface is formed by the flexible member is described. Comparatively, in the fourth embodiment, a situation that a protrusion 134 is formed or covered by a flexible member is described. FIG. 5(*a*) is an enlarged side view of a part of a keyboard device according to the fourth embodiment of the invention. Moreover, the same reference numbers are used in the second embodiment and the first embodiment to refer to the same or like parts, and the descriptions thereof are omitted.

A key 103 is a bar-shape member made of synthetic resin and having a U-shape cross section opened towards the bottom side (a lower side of FIG. 5(*a*)), and the protrusion 134 protrudes downwards from the bottom surface of the key 103. An envelope having a flexible member is formed on the surface of the protrusion 134 through a two-color molding process. In this way, the generation of the scratching noise resulted from friction between the protrusion 134 and the sliding surface 45 is greatly suppressed, and increasing the number of used parts is also suppressed.

Moreover, instead of forming the envelope on the surface of the protrusion 134 through the two-color molding process, a coating or adhesion process can also be performed to form the envelope. Moreover, instead of forming the envelope, the flexible member can be used to form the whole protrusion 134.

A fifth embodiment is provided below with reference to FIG. 5(*b*). In the third embodiment, a situation that the flexible member is integrally formed with the hammer body 241 to form the receiving portion 241*a* (the sliding surface) through the two-color molding process is described. Comparatively, in the fifth embodiment, a situation that a flexible member is coated on a hammer body 341, for example, to form a sliding surface 345 is described. FIG. 5(*b*) is a partial cross-sectional view of a hammer 304 of a keyboard device according to the fifth embodiment of the invention. Moreover, the same reference numbers are used in the first embodiment to refer to the same or like parts, and the descriptions thereof are omitted.

The hammer 304 includes a hammer body 341 fabricated with synthetic resin. A flexible member is coated on a surface surrounded by a wall portion 346 erected at a back end of the hammer body 341, so as to form the sliding surface 345 after hardening. Accordingly, the sliding surface 345 can be formed during maintenance even if the sliding surface of the keyboard device is not formed by the flexible member. Moreover, the sliding surface 345 can be mended. As a result, a long-term effect of mitigating the scratching noise caused by friction between the protrusion 34 and the sliding surface 345 is achieved. Moreover, instead of forming the sliding surface 345 through coating, a flexible member can additionally be used to fabricate the sliding surface 345; then, the sliding surface 345 is adhered to the hammer body 341.

A sixth embodiment is provided below with reference to FIG. 5(*c*). In the sixth embodiment, a protrusion 234 capable of mitigating the clicking sense generated in the key-releasing operation is described. FIG. 5(*c*) is an enlarged side view of a part of a keyboard device according to the sixth embodiment of the invention. Moreover, the same reference numbers are used in the first embodiment to refer to the same or like parts, and the descriptions thereof are omitted.

A key 203 is a bar-shape member fabricated with synthetic resin and having a U-shape cross section opened towards the bottom side (a lower side of FIG. 5(*c*)), and the protrusion 234 protrudes downwards from the bottom surface of the key 203. The protrusion 234 has a first surface 234*a* and a second surface 234*b*. The first surface 234*a* faces a moving direction of the protrusion 234 in the key-pressing operation and is connected to the sliding surface 45. The second surface 234*b* faces a moving direction of the protrusion 234 in the key-releasing operation and is connected to the sliding surface 45. In addition, curvatures of the first surface 234*a* and the second surface 234*b* are different.

More specifically, the curvature of the second surface 234*b* is set to be smaller than that of the first surface 234*a*. Accordingly, the second surface 234*b* that moves from the second incline portion 45*e* and crosses over the bump portion 45*d* to arrive to the first incline portion 45*c* in the key-releasing operation has an accompanying property relative to the bump and recess lower than that of the first surface 234*a*. Therefore, compared to the clicking sense of the key-pressing operation, the clicking sense of the key-releasing operation is greatly decreased. In the acoustic piano, there is no clicking sense during the key-releasing process, so that according to the sixth embodiment, the key touching sense of the acoustic piano can be reconstructed.

Figure 6:
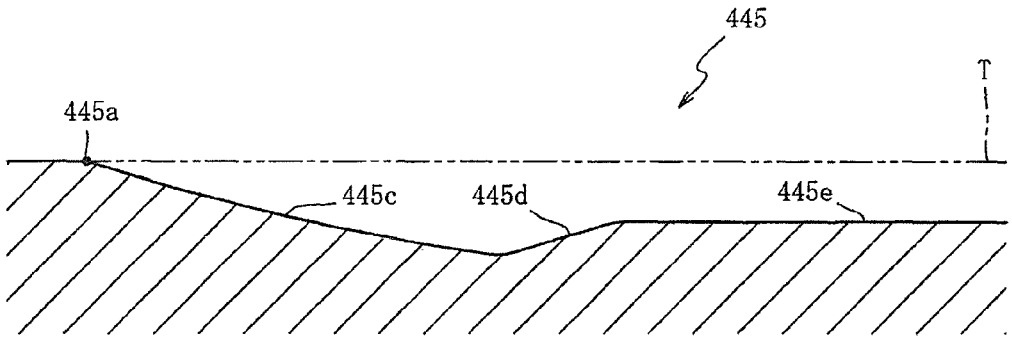
FIG. 6(*a*) is a cross-sectional view of a sliding surface of a keyboard device according to a seventh embodiment of the invention.
Figure 6:
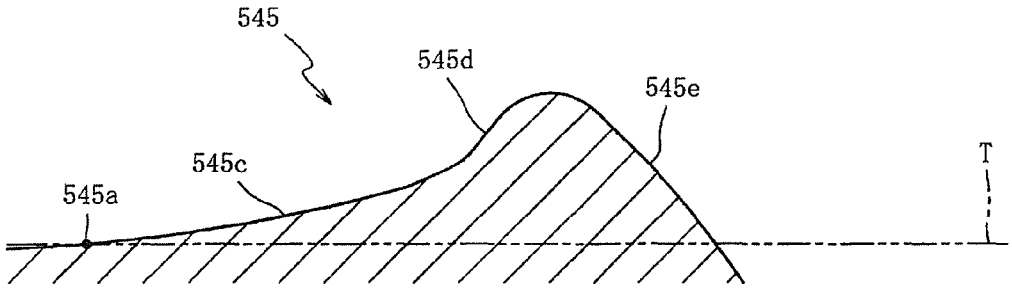
Figure 6:
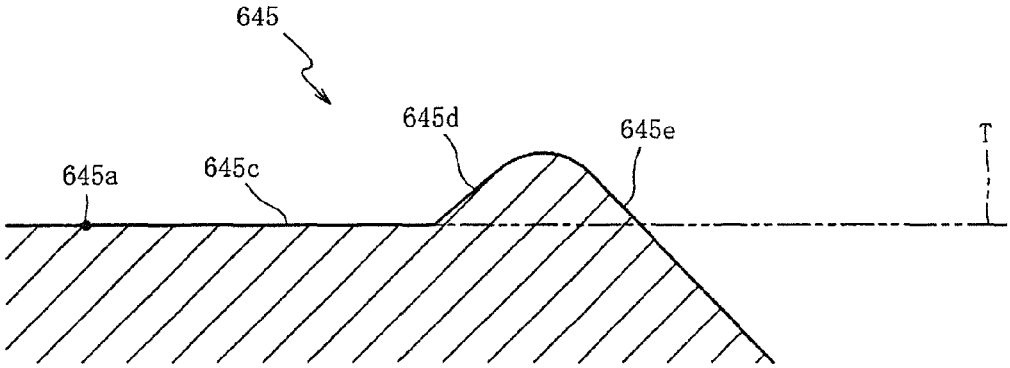

A seventh embodiment is provided below with reference to FIG. 6(*a*). In the first embodiment, a situation that the sliding surface 45 has the second incline portion 45*e* is described. Comparatively, in the seventh embodiment, a situation that a sliding surface 445 has a flat portion 445*e* to replace the second incline portion 45*e* is described. FIG. 6(*a*) is a cross-sectional view of the sliding surface 445 of a keyboard device according to the seventh embodiment of the invention. Moreover, the same reference numbers are used in the first embodiment to refer to the same or like parts, and the descriptions thereof are omitted.

As shown in FIG. 6(*a*), the sliding surface 445 includes the following parts: a first incline portion 445*c* with a curved surface, which is inclined from a start end 445*a* of the sliding surface 445 towards a direction, which is along a sliding direction (from the left to the right of FIG. 6(*a*)) of the protrusion 34 in the key-pressing operation and gradually departs from the base portion 34*a* of the protrusion 34 (referring to FIG. 1); a bump portion 445*d*, which is formed in continuation with the first incline portion 445*c* and is at a place where the protrusion 34 arrives to after passing through the first incline portion 445*c* in the key-pressing operation, and raises up towards a direction, which is along the sliding direction of the protrusion 34 in the key-pressing operation to approach the base portion 34*a* of the protrusion 34; and the flat portion 445*e* with a planar shape, which is formed in continuation with a vertex of the bump portion 445*d* and is at a place where the protrusion 34 arrives to after crossing over the bump portion 445*d* in the key-pressing operation, and is approximately parallel to a tangent line T of the protrusion 34 at the start end 445*a*.

In the seventh embodiment, when the protrusion 34 slides through the first incline portion 445*c* (the curved surface) to arrive to the bump portion 445*d*, a resistance exerted to the protrusion 34 sliding on the first incline portion 445*c* is reduced, so as to suppress a gradual increase in the sense of resistance. Moreover, when the protrusion 34 pushes against the bump portion 445*d*, the sense of resistance can be greatly increased. Since the flat portion 445*e* is located at a place where the protrusion 34 arrives to after crossing over the bump portion 445*d*, a variation in the sense of resistance when the protrusion 34 crosses over the bump portion 445*d* is smaller than that of the first embodiment. However, since the first incline portion 445*c* is inclined towards a direction gradually departing from the base 34*a* of the protrusion 34, even if the variation of the resistance sense 445*d* is relatively small when the protrusion 34 crosses over the bump portion, it can be still recognized that there is a large variation in the resistance sense before and after the bump portion 445*d*. As a result, the unique clicking sense of the acoustic piano can be presented without any sense of incompatibility.

An eighth embodiment is provided below with reference of FIG. 6(*b*). In the first embodiment, a situation that the sliding surface 45 has the first incline portion 45*c* is described. Comparatively, in the eighth embodiment, a situation that a sliding surface 545 has a ramp portion 545*c* to replace the first incline portion 45*c* is described. FIG. 6(*b*) is a cross-sectional view of the sliding surface 545 of a keyboard device according to the eighth embodiment of the invention. Moreover, the same reference numbers are used in the first embodiment to refer to the same or like parts, and the descriptions thereof are omitted.

As shown in FIG. 6(*b*), the sliding surface 545 includes the following parts: the ramp portion 545*c* with a curved surface, which is inclined from a start end 545*a* of the sliding surface 545 towards a direction, which is along a sliding direction (from the left to the right of FIG. 6(*b*)) of the protrusion 34 in the key-pressing operation to gradually approach the base portion 34*a* of the protrusion 34 (referring to FIG. 1); a bump portion 545*d*, which is formed in continuation with the ramp portion 545*c* and is at a place where the protrusion 34 arrives to after passing through the ramp portion 545*c* in the key-pressing operation, and raises up towards a direction, which is along the sliding direction of the protrusion 34 in the key-pressing operation to approach the base portion 34*a* of the protrusion 34; and a second incline portion 545*e* with a curved surface, which is formed in continuation with the bump portion 545*d* and is at a place where the protrusion 34 arrives to after crossing over the bump portion 545*d* in the key-pressing operation, and is inclined towards a direction, which is along a sliding direction of the protrusion 34 in the key-pressing operation and gradually departs from the base portion 34*a* of the protrusion 34.

In the eighth embodiment, when the protrusion 34 slides through the ramp portion 545*c* to reach the bump portion 545*d*, the resistance sense is gradually increased. Moreover, when the protrusion 34 pushes against the bump portion 545*d*, the resistance sense can be greatly increased. A variation in the sense of resistance is smaller than that of the first embodiment when the protrusion 34 pushes against the bump portion 545*d*. However, the variation in the sense of resistance is increased when the protrusion 34 crosses over the bump portion 545*d* to arrive to the second incline portion 545*e* (the curved surface); accordingly, it can be recognized that there is a large variation in the sense of resistance before and after the bump portion 545*d*. As a result, the unique clicking sense of the acoustic piano can be presented without any sense of incompatibility.

A ninth embodiment is provided below with reference of FIG. 6(*c*). In the first embodiment, a situation that the sliding surface 45 has the first incline portion 45*c* is described. Comparatively, in the ninth embodiment, a situation that a sliding surface 645 having a flat portion 645*c* replaces the first incline portion 45*c* is described. FIG. 6(*c*) is a cross-sectional view of the sliding surface 645 of a keyboard device according to the ninth embodiment of the invention. Moreover, the same reference numbers are used in the first embodiment to refer to the same or like parts, and the descriptions thereof are omitted.

As shown in FIG. 6(*c*), the sliding surface 645 includes the following parts: the flat portion 645*c* with a planar shape, which is approximately parallel to a tangent line T of the protrusion 34 (referring to FIG. 1) at the start end 645*a* of the sliding surface 645; a bump portion 645*d*, which is formed in continuation with the flat portion 645*c* and is at a place where the protrusion 34 arrives to after crossing through the flat portion 645*c* in the key-pressing operation, and raises up towards a direction, which is along the sliding direction of the protrusion 34 in the key-pressing operation to approach the base portion 34*a* of the protrusion 34; and a second incline portion 645*e* with a planar shape, which is formed in continue with the bump portion 645*d* and located at a place where the protrusion 34 reaches after crossing over the bump portion 645*d* in the key-pressing operation, and is inclined towards a direction, which gradually departs from the base portion 34*a* of the protrusion 34 along a sliding direction of the protrusion 34 in the key-pressing operation.

In the ninth embodiment, when the protrusion 34 slides through the flat portion 645*c* to reach the bump portion 645*d*, the sense of resistance is gradually increased. Moreover, when the protrusion 34 pushes against the bump portion 645*d*, the sense of resistance can be greatly increased. A variation of the sense of resistance when the protrusion 34 pushes against the bump portion 645*d* is smaller than that of the first embodiment. However, the variation in the sense of resistance when the protrusion 34 crosses over the bump portion 645*d* to arrive to the second incline portion 645*e* (the curved surface) is increased; hence, it can be recognized that there is a large variation in the sense of resistance before and after the bump portion 645*d*. As a result, the unique clicking sense of the acoustic piano can be presented without any sense of incompatibility.

The invention is described with reference of the aforementioned embodiments, though the invention is not limited thereto, and it can be deduced that various modifications and variations can be made without departing from the scope or spirit of the invention. For example, the values mentioned in the aforementioned embodiments are only used as an example, and other values can also be adopted.

In the aforementioned embodiments, a situation that the protrusion 34 of the key 3 leans against the sliding surface 45 located at the back of the hammer supporting protrusion 43, and the mass body 42 of the hammer 4 rotates at the front portion of the chassis 2 is described. It should be understood that the invention is not limited thereto. For example, a shape of the chassis 2, a position of accommodating the hammer 4, and a position of the protrusion 34 can be modified to achieve a situation that the protrusion 34 of the key 3 slides on the sliding surface 45 located at the front of the hammer supporting protrusion 43, and the mass body 42 of the hammer 4 rotates at the back portion of the chassis 2.

In the aforementioned embodiments, a situation that the protrusion 34 is formed on the key 3 in protrusion and the sliding surface 45 is formed on the hammer 4 is described. It should be understood that the invention is not limited thereto. For example, the protrusion and the sliding surface can be formed at places suitable for being sliding contacted with each other during the key pressing operation or key releasing operation. For example, according to the disclosure of the Patent document 1 (referring to FIG. 7(*a*)), the protrusion 34 is configured at a specific portion of the hammer 4 in protrusion, and the sliding surface 45 is formed at a specific portion of the key 3. Moreover, according to the disclosure of the Patent document 2 (referring to FIG. 7(*b*)), the protrusion 34 is configured at a specific portion of the hammer 4 in protrusion, and the sliding surface 45 is formed at a specific portion (the guide portion 602*a*) of the chassis 2.

Certainly, the invention is not limited thereto. For example, the protrusion 34 can be configured at the specific portion of the hammer 4 in protrusion, and on the other hand, the sliding surface 45 is formed at a bottom surface of the key 3. Alternatively, the protrusion 34 is configured at the specific portion of the hammer 4 in protrusion, and on the other hand, the sliding surface 45 is formed on the bottom surface of the chassis 2. Positions of the protrusion and the sliding surface can be suitably determined according to a shape of the chassis 2 or the hammer 4 and a position of the rotation shaft.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A keyboard device, comprising:

a key, supported by a chassis in a free-rotation manner;

a hammer, displaced rotationally corresponding to a key-pressing operation or a key-releasing operation of the key to provide an action load to the key;

a protrusion, projected at a specific position on the hammer or the key, and displaced corresponding to the key-pressing operation or the key-releasing operation;

a sliding surface, formed on any one of the chassis, the key, and the hammer, and having a flat surface or a curved surface inclined to a direction which is along a sliding direction of the protrusion in the key-pressing operation and gradually departs from a base portion of the protrusion, and where the protrusion slides thereon in the key-pressing operation or the key-releasing operation; and a bump portion, formed in continuation with the flat surface or the curved surface, and raising up from the sliding surface towards a direction which is along a sliding direction of the protrusion in the key-pressing operation and approaches the base portion of the protrusion.

2. The keyboard device as claimed in claim 1, wherein, the sliding surface comprises a first incline portion, and the first incline portion is located at a section from where the protrusion starts to slide to the bump portion in the key-pressing operation, and is inclined to a direction which is along a sliding direction of the protrusion in the key-pressing operation and gradually departs from the base portion of the protrusion.

3. The keyboard device as claimed in claim 2, wherein, the sliding surface comprises a second incline portion, and the second incline portion is located at a place where the protrusion reaches after crossing over the bump portion in the key-pressing operation, and is inclined to a direction which is along a sliding direction of the protrusion in the key-pressing operation and gradually departs from the base portion of the protrusion, and the second incline portion has an inclined angle greater than an inclined angle of the first incline portion.

4. The keyboard device as claimed in claim 2, wherein, the bump portion has an inclined angle greater than an inclined angle of the first incline portion.

5. The keyboard device as claimed in claim 1, wherein, the protrusion is formed at a specific portion of the key, and the sliding surface is formed at a specific portion of the hammer, and is located at a position where an included acute angle formed between a straight line connecting a start end of the sliding surface and a rotation shaft of the hammer in the key-releasing operation, and a plane passing through a rotation shaft of the key and the rotation shaft of the hammer is 30°-60°.

6. The keyboard device as claimed in claim 1, wherein, the protrusion or the sliding surface is formed or covered by a flexible member.

7. The keyboard device as claimed in claim 1, wherein, the hammer comprises a connection protrusion and a connection member, the connection protrusion is protruded and disposed on a hammer body, and the connection member is connected to the connection protrusion, and is integrally formed with a flexible member to form the sliding surface, the connection member comprises an insertion hole, and the insertion hole is formed under the sliding surface and is inserted by the connection protrusion.

8. The keyboard device as claimed in a claim 1, wherein, the sliding surface is located under the protrusion;

any one of the chassis, the key and the hammer comprises a wall portion, and the wall portion is erected around the sliding surface and surrounds the sliding surface.

* * * * *